US007717421B2

(12) United States Patent
Rennick et al.

(10) Patent No.: US 7,717,421 B2
(45) Date of Patent: May 18, 2010

(54) SYSTEM AND METHOD FOR SENSING A MEDIA STACK FROM SIDE OF STACK AND DELIVERY PATH TO STACK TO DETECT GIVEN STACK HEIGHT

(75) Inventors: David Erwin Rennick, Georgetown, KY (US); Edward Lynn Triplett, Lexington, KY (US); Gary Michael Tylicki, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 22 days.

(21) Appl. No.: 12/184,354

(22) Filed: Aug. 1, 2008

(65) Prior Publication Data

US 2010/0025924 A1 Feb. 4, 2010

(51) Int. Cl.
*B65H 29/00* (2006.01)

(52) U.S. Cl. ..... 271/207; 399/405

(58) Field of Classification Search ..... 271/207, 271/278, 220, 288, 224; 270/58.02; 399/405
See application file for complete search history.

(56) References Cited

U.S. PATENT DOCUMENTS 5,963,754 A * 10/1999 Itoh et al. ..... 399/21
6,279,899 B1 * 8/2001 Coffey et al. ..... 271/220
6,408,147 B1 * 6/2002 Oshida ..... 399/82
6,851,668 B2 * 2/2005 Mui et al. ..... 271/3.17
6,942,206 B2 * 9/2005 Kuwata et al. ..... 270/58.08
7,292,820 B2 11/2007 Triplett et al.
2009/0001659 A1 * 1/2009 McNamara et al. ..... 271/220

* cited by examiner

*Primary Examiner*—Kaitlin S Joerger
(74) *Attorney, Agent, or Firm*—John Flanagan; John Victor Pezdek

(57) ABSTRACT

A system for sensing a media stack to detect a given stack height includes a stack site in an output bin and a mechanical flag mounted adjacent to a side thereof in a counterbalanced state at a home position where an exposed portion of the flag extends into a media sheet delivery path where it is struck by an edge of repetitive media sheets moving to the site. The striking of the exposed portion by the sheet edge causes the flag to deflect to a displaced position outside of the delivery path, allowing the sheet to land on the site increasing the height of a media sheet stack at the site. The counterbalanced state further allows the flag to return to the home position with its exposed portion in the media path until a given stack height is reached where the stack blocks further return of the flag indicating that the output bin is full.

18 Claims, 4 Drawing Sheets

SYSTEM AND METHOD FOR SENSING A MEDIA STACK FROM SIDE OF STACK AND DELIVERY PATH TO STACK TO DETECT GIVEN STACK HEIGHT

BACKGROUND

1. Field of the Invention

The present invention relates generally to an image forming apparatus and, more particularly, to a system and method for sensing a media stack from a side of the stack and a side of a delivery path to the stack in order to detect a given stack height and thus when an output bin of the image forming apparatus is full.

2. Description of the Related Art

Traditional output bin sensing systems in image forming apparatus, such as electrophotographic printers, use a mechanical flag and sensor mechanism to sense when the height of a media stack reaches a predetermined level. When this happens, the system will generate output signals indicating the output bin is full and instruct the user to remove the media stack before proceeding with additional jobs. This system typically includes a mechanical flag type arm that acts on the top of the media stack in the output bin. An example of such a system is disclosed in U.S. Pat. No. 6,279,889 assigned to the assignee of the present invention.

Many printers are architected in a reverse "C" format where the media sheet exits in the back of the printer and away from the user. An example of such a printer is disclosed in U.S. Pat. No. 7,292,820 assigned to the assignee of the present invention. The traditional output bin full sensing system has a couple of drawbacks related to the human factors involved in using the output bin of these printers. First, the mechanical flag functions on the top of the media stack where it can impede the user in easily removing the stack from the output bin and pulling it towards the front of the printer. Second, if the media stack is replaced by the user into the output bin, the media stack can easily trap the mechanical flag in way that prevents the mechanical flag from functioning properly and thereby potentially leads to unintended media jams. These issues can lead to even worse human factors issues in an All-In-One (AIO) device where a scanner is positioned above the media stack.

Thus, there is a need for an innovation which will satisfactorily overcome the aforementioned drawbacks of the traditional output bin full sensing system without introducing any significant new drawbacks in place thereof.

SUMMARY OF THE INVENTION

The present invention meets this need by providing an innovation that resolves the above-mentioned drawbacks through sensing when a media stack has reached a given height, such as the height that fills the output bin of an image forming apparatus, by measuring the height of the media stack from a side of the stack, instead of the top of the stack, which side is also the same as a side edge position of a media sheet in the media delivery path to the stack. This approach, in particular, is thus useful in conjunction with a reference edge style media feed system.

Accordingly, in an aspect of the present invention, a system for sensing a media stack in order to detect a given height of the stack includes a media sheet stack site and a media contact member movably mounted adjacent to a side of the media sheet stack site in a predetermined state, such as a counterbalanced state, at a home position such that a contact element of the contact member extends into a path of delivery of repetitive media sheets to the stack site where the contact element is exposed to being struck by an edge of media sheets repetitively moving in the delivery path that causes the media contact member to repetitively movably deflect from the home position to a displaced position allowing each media sheet to repetitively pass the contact element of the media contact member and reach the stack site increasing the height of a stack of media sheets at the site, the predetermined state further causing the media contact member to repetitively movably return from the displaced position to the home position after each repetitive media sheet has passed the contact element of the media contact member until the given height of the media stack is reached at which the media contact member cannot return to the home position due to the contact element of the media contact member being unable to extend into the delivery path of the media sheet due to the presence of the media stack. The system further includes a sensor member disposed adjacent to the media contact member and operable to sense movement of the media contact member and in response thereto produce output that distinguishes between the media contact member at the home and displaced positions so as to provide an indication when the media stack is at the given height.

In another aspect of the present invention, a method for sensing a media stack in order to detect a given height of the stack includes movably mounting a media contact member adjacent to a side of a media sheet stack site in a predetermined state at a home position, placing a contact element of the media contact member into a path of delivery of a media sheet to the stack site where the contact element is exposed to being struck by an edge of media sheets repetitively moving in the delivery path, movably deflecting the media contact member repetitively from the home position to a displaced position in response to the edge of media sheets striking the contact element of the media contract member, allowing media sheets to repetitively pass the contact element of the media contact member and reach the stack site increasing the height of a stack of media sheets at the stack site, and movably returning the media contact member repetitively from the displaced position to the home position after each repetitive media sheet has passed the contact element of the media contact member until the given height of the media stack is reached at which the media contact member cannot return to the home position due to the contact element of the media contact member being unable to extend into the delivery path of the media sheet due to the presence of the media stack. The sensing method further includes sensing movement of the media contact member between the home and displaced positions, and in response thereto producing an output that distinguishes between the media contact member at the home and displaced positions so as to provide an indication when the media stack is at the given height.

BRIEF DESCRIPTION OF THE DRAWINGS

Figure 1:
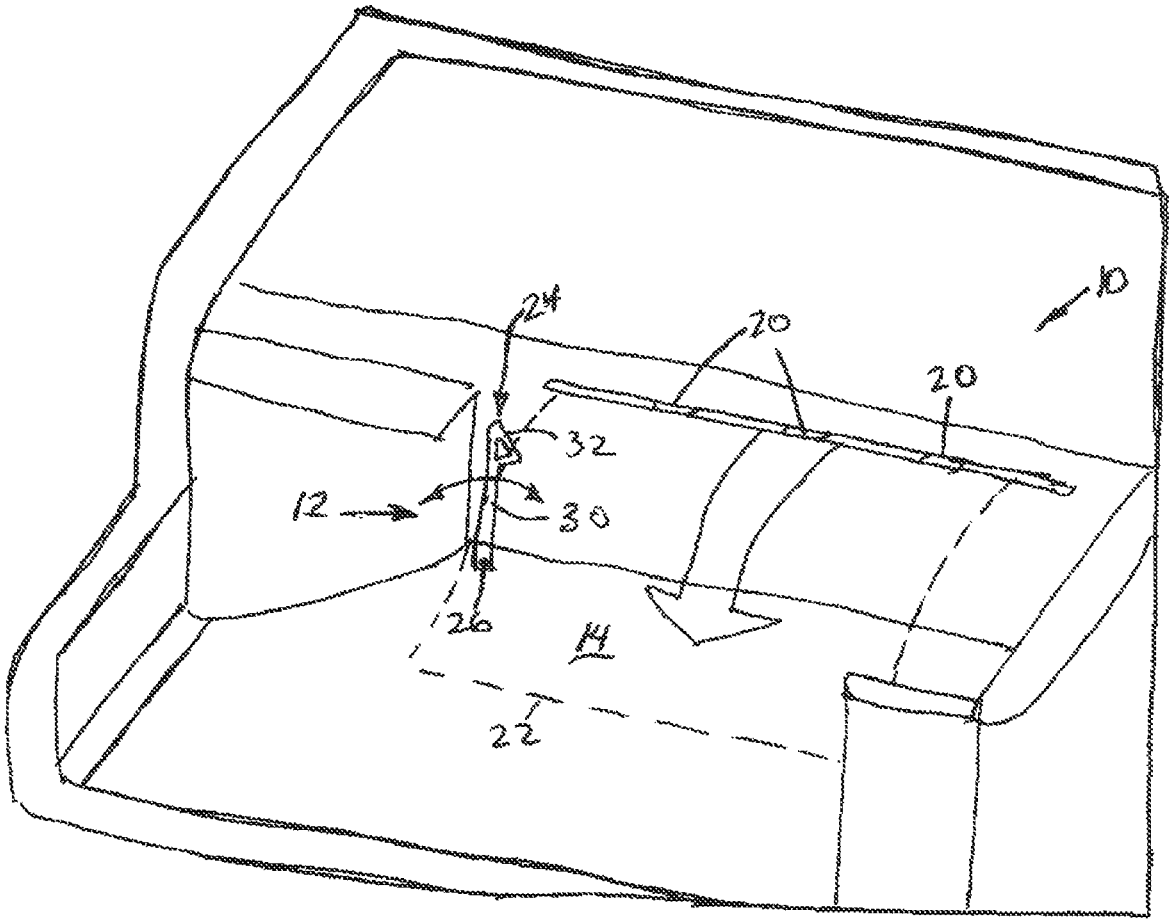

Having thus described the invention in general terms, reference will now be made to the accompanying drawings, which are not necessarily drawn to scale, and wherein:

FIG. 1 is a schematic perspective view of an output bin of an image forming apparatus in which a sensing system and method of the present invention are employed for media stack side sensing of when the media stack reaches a given height to detect when the output bin is full.

Figure 2:
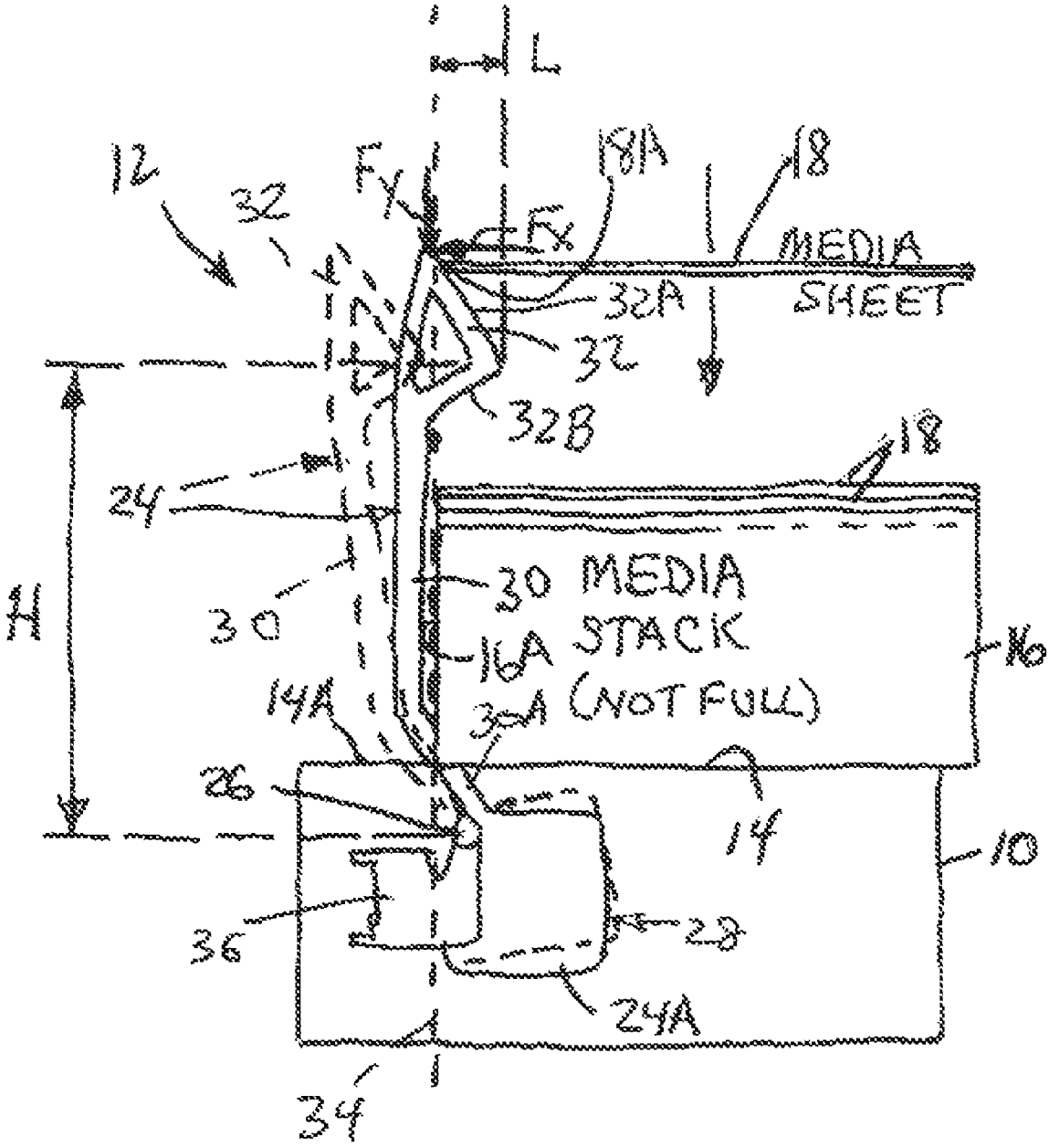

FIG. 2 is a schematic side elevational view of a flag and sensor of the system and used by method of the present invention, showing the flag and sensor at a stack side home position when the output bin is not yet full.

Figure 3:
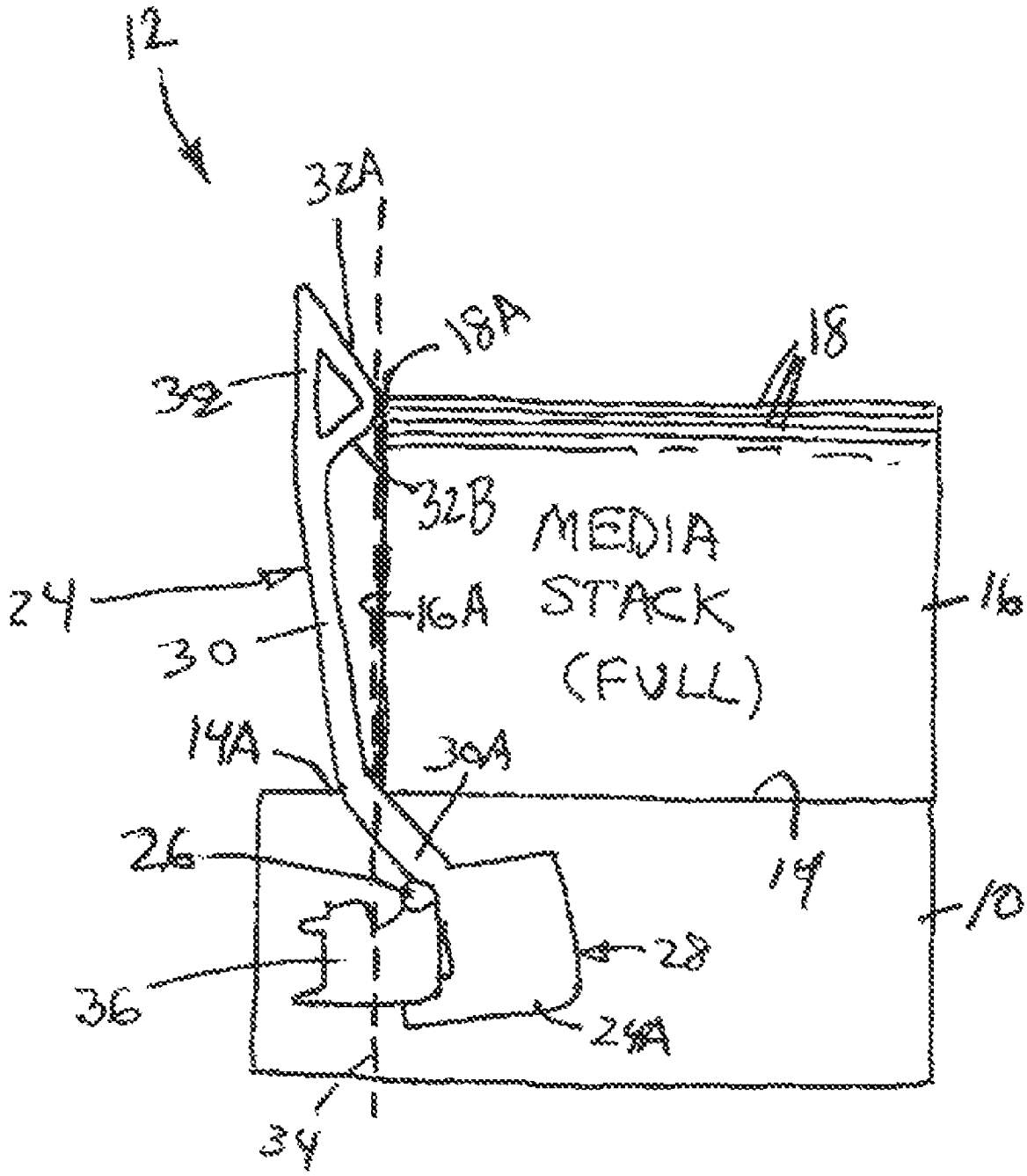

FIG. 3 is a schematic side elevational view similar to that of FIG. 2 but now showing the flag and sensor at a stack side deflected position to which the flag is pivotally displaced from its original home position by the force of impact of an individual media sheet on the flag while in the media sheet delivery path to the media stack, the flag being prevented from returning to its original home position as a result of the media stack reaching the given height at which output bin is full.

Figure 4:
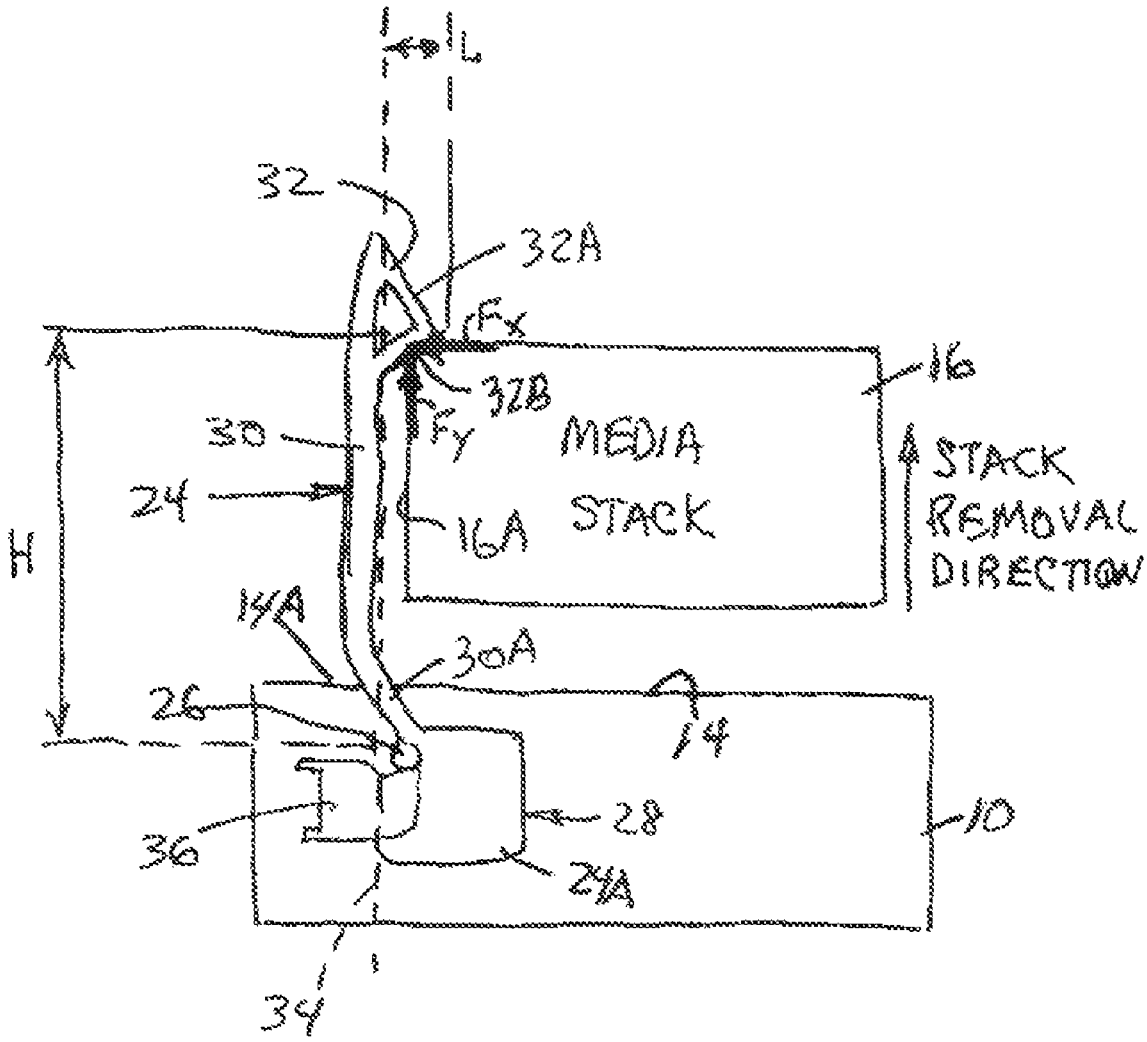

FIG. 4 is a schematic side elevational view similar to that of FIG. 2 but now showing the media stack being lifted and moved in a removal direction relative to the flag and sensor.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1-3, there is illustrated a media output bin, generally designated 10, of an image forming apparatus, such as an electrophotographic printer. A stack side sensing system, generally designated 12, of the present invention, operating in accordance with a stack side sensing method of the present invention, is employed at a media sheet stack site 14 in the output bin 10 for sensing when a media stack 16 (see FIG. 3) reaches a given height in order to detect when the output bin 10 is full. A media sheet 18 (see FIG. 2) is discharged by exit rollers 20 of the printer into a media sheet delivery path 22, as represented by dashed lines in FIG. 1, such that the media sheet 18 falls onto the site 14 in the output bin 10, landing on the media stack 16 and increasing its height.

The stack side sensing system 12 located in the output bin 10 includes the media sheet stack site 14 and a media contact member, such as in the form of a mechanical flag 24, pivotally mounted at 26 located adjacent to a side 14A of the site 14 in a predetermined, such as a counterbalanced, orientation or state by a predetermined load 28, such as a weighted portion 24A of the flag 24 or an external spring or other suitable means. In the counterbalanced state, the flag 24 is normally disposed in an upright home position, as seen in FIG. 1 and in the solid line form in FIG. 2.

The flag 24 has an elongated stem element 30 and a contact element 32. The stem element 30 is pivotally mounted to the side 14A of the media sheet stack site 14 at the location 26 adjacent to one end 30A of the stem element 30 such that the stem element 30 normally extends along a reference line 34 which corresponds to an upright side edge 16A of the stack 16 of media sheets 18 and the edge 18A of the media sheet 18 as it is delivered along the path to the stack site 14. The stack 16 is increased in height at the site 14 by repetitive delivery of media sheets 18 along the path 22 to the site 14. The contact element 32 of the flag 24 has an exposed tip surface portion 32A which extends or protrudes beyond the reference line 34 and thus into the path 22 of the repetitive delivery of the media sheets 18 to the site 14 when the mechanical flag 24 is at the upright home position.

The contact element 32 is exposed to being struck by the edge 18A of the media sheets 18 repetitively moving in the delivery path 22. Such repetitive striking of the contact element 32 by the sheet edge 18A causes the flag 24 to movably or pivotally deflect from the home position, as shown in solid line form in FIG. 2, to a displaced position, as shown in dashed line form in FIG. 2, allowing each media sheet 18 to repetitively pass the contact element 32 and reach the stack site 14, increasing the height of the stack 16 of media sheets 18 at the stack site 14. The predetermined or counterbalanced state of the flag 24 further causes it to movably or pivotally return from the displaced position to the home position after each repetitive media sheet 18 has passed the contact element 32 of the flag 24 until the given height of the media stack 16 is reached at which point the flag 24 cannot return to the home position due to the contact element 32 of the flag 24 being unable to extend or protrude into the delivery path 22 of the media sheet 18 due to the presence of the media stack 16.

As shown in FIGS. 2-4, the system 12 also includes a sensor member 36 disposed adjacent to the mechanical flag 24. The sensor member 36 is operable to sense movement of the flag 24 and produce an output that distinguishes between the flag 24 being at the upright home position and the inclined displaced position. In such manner, the output of the sensor member 36 provides an indication when the stack 16 of media sheets 18 has increased to the given height and that the output bin 10 is full. The sensor member 36 can be of any suitable well-known type, such as in the form of photo-interrupters or other electro-mechanical switches. The flag 24 may be the type that has a shutter mounted thereon that will move with it and block light passage between portions of the sensor member 36 at certain angular positions of the flag 24 but not at other angular positions, with the blocking or non-blocking of light passage causing the sensor member 36 to produce different outputs, which may be of analog or digital form.

FIG. 2 shows the sensing flag 24 when the stack 16 has not reached the given height and thus the output bin 10 is not full. FIG. 3 shows the sensing flag 24 when the stack 16 and thus the output bin 10 are full. Dimension L shown in FIG. 2 is the amount of interference between the known reference edge line 34 of the media sheet 18 and the media stack 16. It is preferred that this dimension is sufficient enough to generate a displacement of the flag 24 at the sensor member 36 to cause the photo beam to break reliably. This ideally is in the range of 1-20 mm. Dimension H is the distance from the pivot 26 of the flag 24 to where the sheet 18 strikes the contact element 32 of the flag 24. It is desired that this distance be large so that a small force on the contact element 32 of the flag 24 creates a large moment at the pivot 26 of the flag 24 to activate the sensor member 36. This large dimension also makes the design more insensitive to the weight and stiffness of the media.

Regarding the forces $F_x$ and $F_y$ shown in FIG. 2, as the trailing edge of a media sheet 18 falls from the paper exit rollers 20 onto the sensing flag 24, the edge 18A of the sheet 18 strikes the contact element 32 of the flag 24 creating a force on the top thereof. The $F_x$ component of this force causes the moment about the pivot 26 that rotates or pivots the flag 24 and allows the sheet to pass and drop into the stack 16 at the site 14. The angled surface portion 32A on the top side of the tip or contact element 32 of the flag 24 allows the trailing edge of the sheet 18 to create the $F_x$ component of the force that actuates the flag 24. It is desirable that this angle be 45° or less from vertical to ensure proper operation of the system 12. As the flag 24 rotates or pivots to relieve the interference with the sheet reference edge 34, the sheet falls into the output bin 10 and the flag 24 returns to its home position either under the influence of gravity due to its inherent counterbalanced load or weight or under a spring load.

When the media stack height is achieves the full position, as seen in FIG. 3, the flag 24 can no longer rotate or pivot back into the output bin site or its home position. At this point, the beam of the sensor member 36 is made for a long length of time and the printer engine firmware detects that the output bin 10 is full and prompts a user to remove the media stack 16. The sensing system 12 that detects output bin full by sensing from the side of the stack 16 allows for easy removal and replacement of the stack 16, as shown in FIG. 4. When the user pulls the stack 16 from the output bin 10, the top of the stack 16 creases a force on the flag 24 having a $F_x$ component that causes a moment about the pivot 26 that rotates or pivots the flag 24 and allows the stack 16 to be removed from the output bin 10. The other angled surface portion 32B on the bottom of the contact element 32 allows the top of the stack 16 to create this component of the force that actuates the flag 24. It is desired that this angle be 135° or more from vertical to ensure proper orientation of the system 12. As the flag 24 rotates or pivots to relieve the interference with the top of the stack 16, the user can easily remove the stack 16 from the output bin 10 and the flag 24 returns to its home position either under the influence of gravity or under a spring load.

The benefits and advantages of the present invention may be summarized as follows: (1) provides a means of sensing when the output bin is full based upon detecting the height of the stack by sensing from the side of the stack (as opposed to the traditional approach of sensing stack full on the top of the stack); (2) by sensing bin full on the side of the stack, the human factors of removing the stack from and putting the stack back into the output bin can be improved since the user does not have to work the top of the stack out from under a bin full sensing flag; (3) the system is scalable to the desired output capacity of the bin; (4) allows for improved human factors where the paper path is of a reverse "C" architecture; (5) allows for improved human factors where the device is an AIO with a scanner positioned on the top of the printer and impedes the user from removing the stack from the output bin; and (6) geometry allows for flag to easily pivot out of the way under small applied load of falling sheets from the exit rollers or when the stack is removed from the bin.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A system for sensing a media stack in order to detect a given height of the stack, said system comprising:

a media sheet stack site; and a media contact member movably mounted adjacent to a side of said media sheet stack site in a predetermined state at a home position such that a contact element of said media contact member extends into a path of delivery of a media sheet to said stack site where said contact element is exposed to being struck by an edge of media sheets repetitively moving in said delivery path that causes said media contact member to repetitively movably deflect from said home position to a displaced position allowing each media sheet to repetitively pass said contact element of said media contact member and reach said stack site increasing the height of a stack of media sheets at said stack site, said predetermined state further causing said media contact member to repetitively movably return from said displaced position to said home position after each repetitive media sheet has passed said contact element of said media contact member until the given height of the media stack is reached at which said media contact member cannot return to said home position due to said contact element of said media contact member being unable to extend into said delivery path of the media sheet due to the presence of the media stack.

2. The system of claim 1 wherein said media contact member in said predetermined state is counterbalanced at said home position adjacent to said side of said media sheet stack site.

3. The system of claim 1 wherein said media contact member has a stem element pivotally mounted to said side of said media sheet stack site at a location adjacent to one end of said stem element.

4. The system of claim 3 wherein said stem element at said home position of said media contact member extends along but outside of a reference line representing the position of the edge of the media sheet in the delivery path such that said stem element of said media contact member stays outside of the delivery path during movement of said media contact member between said home and displaced positions.

5. The system of claim 4 wherein said contact element of said media contact member is connected to said stem element adjacent to another end of said stem element opposite from said one end thereof and has a surface portion that protrudes across the reference line into, and at inclined angular relationship to, said media sheet delivery path when said media contact member is at said home position and is struck by the edge of the repetitive media sheets moving in said delivery path.

6. The system of claim 1 further comprising:

a sensor member disposed adjacent to said media contact member and operable to sense movement of said media contact member and in response thereto produce an output that distinguishes between said media contact member at said home and displaced positions so as to provide an indication when the media stack is at the given height.

7. The system of claim 6 wherein said sensor member is an optical interrupter.

8. The system of claim 7 wherein said media contact member is a mechanical flag.

9. The system of claim 1 wherein said media contact member is a mechanical flag.

10. A system for sensing an output bin full, comprising:

a stack site in an output bin; and a mechanical flag mounted adjacent to a side of said stack site in a counterbalanced state at a home position where an exposed surface portion of said mechanical flag extends into a media sheet delivery path where it will be struck by an edge of repetitive media sheets moving to said stack site, said striking of said exposed surface portion by the sheet edge causing said mechanical flag to deflect from said home position to a displaced position outside of said delivery path, allowing the media sheet to land on said site increasing the height of a media sheet stack at said stack site, said counterbalanced state further causing said mechanical flag to return to said home position with said exposed surface portion thereof in the media path until a given stack height is reached where the stack blocks further return of said mechanical flag indicating that said output bin is full.

11. The system of claim 10 wherein said mechanical flag has a stem element pivotally mounted to said side of said media sheet stack site at a location adjacent to one end of said stem element.

12. The system of claim 11 wherein said stem element at said home position of said flag extends along but outside of a reference line representing the position of the edge of the media sheet in said delivery path such that said stem element of said flag stays outside of said delivery path during movement of said flag between said home and displaced positions.

13. The system of claim 12 wherein said mechanical flag has a contact element connected to said stem element thereof adjacent to another end of said stem element opposite from said one end thereof, said exposed surface portion being one said contact element that protrudes across said reference line into, and at inclined angular relationship to, said media sheet delivery path when said flag is at said home position and is struck by the edge of the repetitive media sheets moving in said delivery path.

14. The system of claim 10 further comprising:

a sensor member disposed adjacent to said mechanical flag and operable to sense movement of said flag and in response thereto produce an output that distinguishes between said flag at said home and displaced positions so as to provide an indication when the media stack is at the given height.

15. The system of claim 14 wherein said sensor member is an optical interrupter.

16. A method for sensing a media stack in order to detect a given height of the stack, said method comprising:

movably mounting a media contact member adjacent to a side of a media sheet stack site in a predetermined state at a home position;

placing a contact element of the media contact member into a path of delivery of a media sheet to the stack site where the contact element is exposed to being struck by an edge of media sheets repetitively moving in the delivery path;

movably deflecting the media contact member repetitively from the home position to a displaced position in response to the edge of media sheets striking the contact element of the media contract member;

allowing media sheets to repetitively pass the contact element of the media contact member and reach the stack site increasing the height of a stack of media sheets at the stack site; and movably returning the media contact member repetitively from the displaced position to the home position after each repetitive media sheet has passed the contact element of the media contact member until the given height of the media stack is reached at which the media contact member cannot return to the home position due to the contact element of the media contact member being unable to extend into the delivery path of the media sheet due to the presence of the media stack.

17. The method of claim 16 further comprising:

sensing movement of the media contact member between the home and displaced positions; and in response thereto, producing an output that distinguishes between the media contact member at the home and displaced positions so as to provide an indication when the media stack is at the given height.

18. The method of claim 16 wherein said predetermined state of said media contact member at said home position is a counterbalanced state.

* * * * *